US010959913B2

(12) United States Patent
Totman et al.

(10) Patent No.: US 10,959,913 B2
(45) Date of Patent: Mar. 30, 2021

(54) PROVIDING FEEDBACK FOR CPR TREATMENT

(71) Applicant: ZOLL Medical Corporation, Chelmsford, MA (US)

(72) Inventors: Mark Totman, Winchester, MA (US); Timothy Sean McGough, Merrimack, NH (US)

(73) Assignee: ZOLL Medical Corporation, Chelmsford, MA (US)

( * ) Notice: Subject to any disclaimer, the term of this patent is extended or adjusted under 35 U.S.C. 154(b) by 1032 days.

(21) Appl. No.: 15/380,429

(22) Filed: Dec. 15, 2016

(65) Prior Publication Data

US 2017/0112718 A1 Apr. 27, 2017

Related U.S. Application Data

(63) Continuation of application No. 13/788,720, filed on Mar. 7, 2013, now abandoned.

(51) Int. Cl.
*A61H 31/00* (2006.01)

(52) U.S. Cl.
CPC ..... *A61H 31/005* (2013.01); *A61H 31/007* (2013.01); *A61H 2201/5043* (2013.01); *A61H 2201/5061* (2013.01); *A61H 2201/5084* (2013.01); *A61H 2201/5097* (2013.01)

(58) Field of Classification Search
CPC .... A61H 31/00; A61H 31/004; A61H 31/005; A61H 31/007; A61H 2201/5084; A61H 2201/5043; A61H 2201/5097; A61H 2201/5061
See application file for complete search history.

(56) References Cited

U.S. PATENT DOCUMENTS

| | | | | |
|---|---|---|---|---|
| 4,797,104 | A * | 1/1989 | Laerdal | G09B 23/288 434/265 |
| 5,496,257 | A * | 3/1996 | Kelly | A61H 31/005 600/454 |
| 7,108,665 | B2 | 9/2006 | Halperin et al. | |
| 7,429,250 | B2 | 9/2008 | Halperin et al. | |
| 7,650,181 | B2 | 1/2010 | Freeman et al. | |
| 7,993,290 | B2 * | 8/2011 | Lund | A61H 31/00 601/41 |
| 8,034,006 | B2 | 10/2011 | Celik-Butler et al. | |
| 8,096,962 | B2 | 1/2012 | Palazzolo et al. | |
| 8,121,681 | B2 | 2/2012 | Hampton et al. | |
| 8,147,433 | B2 | 4/2012 | Halperin et al. | |
| 8,333,720 | B2 | 12/2012 | Nysaether | |

(Continued)

FOREIGN PATENT DOCUMENTS

| | | | |
|---|---|---|---|
| CN | 2894682 | Y | 5/2007 |
| EP | 1491175 | A1 | 12/2004 |

*Primary Examiner* — Colin W Stuart
*Assistant Examiner* — Douglas Y Sul
(74) *Attorney, Agent, or Firm* — The Webb Law Firm

(57) ABSTRACT

A method includes receiving a signal representative of chest compressions being applied to a patient; calculating, based on the signal, a first value for a first parameter of the chest compressions; and determining if the first value is included in a first target range. When the first value is included in the first target range, the method includes calculating, based on the signal, a second value for a second parameter of the chest compressions; and determining if the second is included in a second target range.

22 Claims, 5 Drawing Sheets

(56) References Cited

U.S. PATENT DOCUMENTS

| | | | | |
|---|---|---|---|---|
| 2004/0267324 | A1 | 12/2004 | Geheb et al. | |
| 2007/0219588 | A1 | 9/2007 | Freeman | |
| 2008/0145827 | A1* | 6/2008 | Strand | G09B 23/288 434/265 |
| 2010/0049266 | A1 | 2/2010 | Ochs et al. | |
| 2010/0256539 | A1* | 10/2010 | Strand | A61H 31/005 601/41 |
| 2012/0010543 | A1 | 1/2012 | Johnson et al. | |
| 2012/0136286 | A1 | 5/2012 | Nova et al. | |
| 2012/0184882 | A1 | 7/2012 | Totman et al. | |
| 2012/0226204 | A1 | 9/2012 | Coleman et al. | |
| 2013/0023781 | A1* | 1/2013 | Freeman | A61B 5/0535 600/529 |
| 2013/0030326 | A1 | 1/2013 | Bogdanowicz et al. | |
| 2013/0282069 | A1 | 10/2013 | Thiagarajan et al. | |

* cited by examiner

PROVIDING FEEDBACK FOR CPR TREATMENT

CROSS REFERENCE TO RELATED APPLICATIONS

This application is a continuation application of U.S. patent application Ser. No. 13/788,720, filed Mar. 7, 2013, entitled "Providing Feedback for CPR Treatment", which is herein incorporated by reference in its entirety.

TECHNICAL FIELD

This document relates to an approach to providing feedback for cardio-pulmonary resuscitation (CPR) treatment.

BACKGROUND

Sudden health problems such as sudden cardiac arrest and injuries caused by accidents kill thousands of people and cause permanent injury every year. Fast and competent care to resuscitate such victims of these problems can be essential to positive outcomes in such situations. For example, it is said that the chance of surviving a sudden cardiac arrest falls by ten percent for every minute of delay in providing effective treatment.

Resuscitation treatments for patients suffering from cardiac arrest generally include clearing and opening the patient's airway, providing rescue breathing for the patient, and applying chest compressions to provide blood flow to the victim's heart, brain, and other vital organs. If the patient has a shockable heart rhythm (ventricular fibrillation or pulseless ventricular tachycardia), resuscitation also may include defibrillation therapy. Along with such action, an electrocardiogram (ECG) signal for the patient may be electronically captured, displayed, and monitored, so that rescuers can determine when the patient's heart has returned to normal or near-normal operation, and determine when the heart exhibits a shockable rhythm.

SUMMARY

During the delivery of cardiopulmonary resuscitation (CPR) to a victim, feedback is provided about CPR parameters such as the compression rate and compression depth. A feedback device monitors the actual rate of compressions being applied to the victim. To provide such feedback for compression rates, audio, visual, tactile, and/or other types of feedback may be provided to indicate whether the actual compression rate matches a target compression rate and/or falls within a target range. After the target compression rate and/or target range is achieved, the feedback device monitors the actual depth of compressions being applied to the victim. Similarly, depth feedback may be provided as audio, visual, tactile, and/or other types of feedback to indicate whether the actual compression depth matches a target compression depth and/or falls within a target range. By monitoring and providing feedback about only one CPR parameter at a time, a caregiver delivering CPR can easily understand and respond to the feedback.

In a general aspect, a method includes receiving a signal representative of chest compressions being applied to a patient; calculating, based on the signal, a first value for a first parameter of the chest compressions; and determining if the first value is included in a first target range. When the first value is included in the first target range, the method includes calculating, based on the signal, a second value for a second parameter of the chest compressions; and determining if the second is included in a second target range.

Embodiments may include one or more of the following.

The first parameter represents a rate that the chest compressions are applied to the patient.

The second parameter represents the depth that the compressions are applied to the patient.

The method includes providing a first feedback indicative of the first value for the first parameter. In some cases, providing the first feedback includes providing at least one of audio feedback, visual feedback, and tactile feedback. In some cases, the first feedback indicates that the first value is one or more of the following: within the first target range, below the first target range, and above the first target range. In some cases, the first feedback is provided prior to the second value being calculated.

The method includes providing second feedback indicative of the second value for the second parameter. Providing second feedback includes providing at least one of audio feedback, visual feedback, and tactile feedback. The second feedback indicates that the second value is one or more of the following: within the second target range, below the second target range, and above the second target range.

In a general aspect, a system includes an input module configured to receive a signal representative of chest compressions being applied to a patient. The system includes a processor. The system includes at least one memory including computer program code, the at least one memory and the computer program code configured to cause the processor to calculate, based on the signal, a first parameter of the chest compressions and to determine if the first parameter is included in a first target range. The at least one memory and the computer program code are configured to cause the processor to calculate, based on the signal, a second parameter of the chest compressions when the first parameter is included in the first target range; and to determine if the second parameter is included in a second target range.

Embodiments may include one or more of the following.

The first parameter represents a rate that the chest compressions are applied to the patient.

The second parameter represents a depth that the chest compressions are applied to the patient.

The system includes a sensor configured to detect the signal representative of the chest compressions being applied to the patient. In some cases, the sensor includes an accelerometer.

The system includes an output element. In some cases, the output element includes at least one of a speaker, a display screen, one or more lights, a gauge, and a vibration element. In some cases, the at least one memory and the computer program code are configured to cause the processor to cause the output element to output a first feedback indicative of the first parameter. In some cases, the first feedback indicates that the first parameter is one or more of the following: within the first target range, below the first target range, and above the first target range.

In some cases, the at least one memory and the computer program code are configured to cause the processor to cause the output element to output a second feedback indicative of the second parameter. In some cases, the first parameter represents a rate that the chest compressions are being applied to the patient, and wherein the output element includes at least one light configured to flash at a target compression rate. In some cases, the second parameter represents a depth of the chest compressions being applied to the patient, and wherein the output element includes a plurality of lights configured to turn on and turn off sequentially based on the compression depth.

In a general aspect, an apparatus includes an input module configured to receive a signal representative of chest compressions being applied to a patient; a first set of lights configured to represent a rate that the chest compressions are applied to the patient; and a second set of lights configured to represent a depth that the chest compressions are applied to the patient. The apparatus includes a processor. The apparatus includes at least one memory including computer program code, the at least one memory and the computer program code configured to cause the processor to calculate a rate that the chest compressions are applied to the patient based on the signal and to control the first set of lights based on the calculated rate. The at least one memory and the computer program code are configured to cause the processor to calculate a depth of the chest compressions that are applied to the patient based on the signal when the calculated rate is included in a target rate range, and to control the second set of lights based on the calculated depth.

Embodiments may include one or more of the following.

Controlling the first set of lights includes causing at least one of the first set of lights to flash at a target compression rate. In some cases, controlling the first set of lights includes causing a first one of the first set of lights to flash at the target compression rate if the calculated rate is below the target rate range; and causing a second one of the first set of lights to flash at the target compression rate if the calculated rate is above the target rate range.

Controlling the first set of lights includes causing a first one of the first set of lights to be illuminated continuously when the calculated rate falls within the target rate range. In some cases, controlling the first set of lights includes causing the first set of lights to turn off when the calculated compression rate falls within the target rate range.

Controlling the second set of lights includes causing at least a subset of the second set of lights to turn on sequentially and turn off sequentially. In some cases, controlling the second set of lights includes causing a first subset of the second set of lights to turn on sequentially and turn off sequentially if the calculated depth is below a target depth range; causing a second subset of the second set of lights to turn on sequentially and turn off sequentially if the calculated depth is within the target depth range; and causing a third subset of the second set of lights to turn on sequentially and turn off sequentially if the calculated depth is above the target depth range. The third subset includes more lights than the second subset, and wherein the second subset includes more lights than the first subset.

The first set of lights and the second set of lights include at least one of light emitting diodes (LEDs) and organic light emitting diodes (OLEDs).

The first set of lights and the second set of lights include images displayed on a display screen.

The apparatus includes a sensor configured to detect the signal representative of chest compressions being applied to a patient.

In a general aspect, software stored on a computer-readable medium includes instructions for causing a computing system to receive a signal representative of chest compressions being applied to a patient; calculate, based on the signal, a first value for a first parameter of the chest compressions; determine if the first value is included in a first target range; when the first value is included in the first target range, calculate, based on the signal, a second value for a second parameter of the chest compressions; and determine if the second is included in a second target range.

Embodiments may include one or more of the following.

The software includes instructions for causing the computing system to provide a first feedback indicative of the first value for the first parameter. In some cases, the first feedback is provided prior to the second value being calculated.

The software includes instructions for causing the computing system to provide second feedback indicative of the second value for the second parameter.

The approach to providing CPR feedback described herein may have one or more of the following advantages. By providing straightforward feedback about only one CPR parameter at a time, a caregiver can easily interpret the feedback and achieve good CPR performance. For instance, by receiving feedback about a compression rate first, followed by feedback about a compression depth, the caregiver can focus first on correcting the compression rate and then focus on correcting the compression depth.

Inexpensive CPR feedback devices can be provided that integrate the approach to providing CPR feedback described herein. For instance, CPR feedback devices with simple light emitting diode (LED) displays can utilize the approach to providing CPR feedback. In addition, the approach to providing CPR feedback described herein can be used with consumer devices, such as smartphones, thus enabling a wide community of users to make use of the approach.

Other features and advantages are apparent from the following description and from the claims.

DETAILED DESCRIPTION

During the delivery of cardiopulmonary resuscitation (CPR) to a victim, feedback is provided about CPR parameters such as the compression rate and compression depth. Feedback is provided about only one CPR parameter at a time, so that a caregiver applying chest compressions to the victim can easily interpret and respond to the feedback. For instance, feedback about the compression rate may be provided first, so that the caregiver can initially focus only on the compression rate. After the actual compression rate being applied by the caregiver to the victim matches a target compression rate and/or falls within a target compression range, feedback about the compression depth may be provided. Thus, the caregiver can focus on the compression depth only after he or she is already applying chest compressions at the target rate.

A feedback device monitors the actual rate of compressions being applied by a caregiver to the victim. Such feedback regarding the compression rate may be provided in one or more forms. For example, audio, visual, tactile, and/or other types of feedback may be employed to indicate whether the actual compression rate matches a target compression rate and/or falls within a target range. After the target compression rate and/or target range is achieved, the feedback device monitors the actual depth of compressions being applied to the victim. Depth feedback, such as audio, visual, and/or tactile feedback, is provided that indicates whether the actual compression depth matches a target compression depth and/or falls within a target range.

Figure 1:
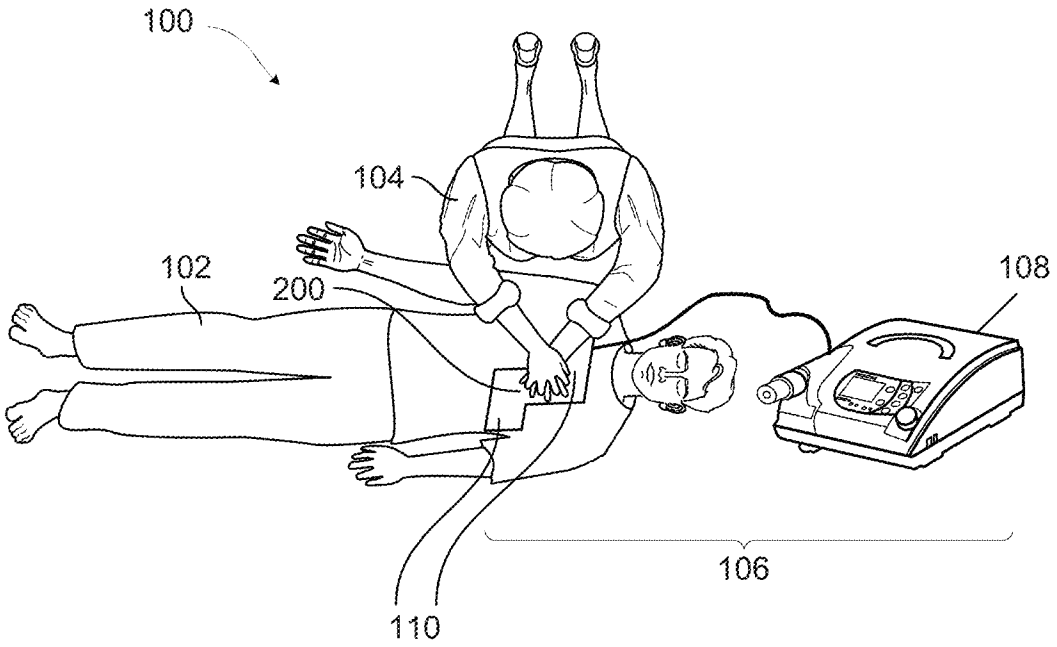
FIG. 1 is a diagram of a rescue scene.

Referring to FIG. 1, at a rescue scene 100, a caregiver 104 performs cardiopulmonary resuscitation (CPR) on a victim 102. An electronic defibrillation system 106 including a defibrillator, such as an automated external defibrillator (AED) 108, a professional defibrillator, or another type of defibrillating apparatus, may instruct the caregiver in performing CPR and may provide defibrillation to the victim 102 via external defibrillator electrode pads 110. The rescue scene 100 may be an emergency scene at which the victim is, for instance, an individual who has apparently undergone sudden cardiac arrest. The rescue scene 100 may also be a simulated rescue scene in a training environment, e.g., for teaching students how to perform CPR. The caregiver 104 may be, e.g., a civilian responder with limited or no training in lifesaving techniques; a first responder, such as an emergency medical technician (EMT), police officer, or firefighter; a medical professional, such as a physician or nurse; or a CPR student. The caregiver 104 may be acting alone or may be acting with assistance from one or more other caregivers, such as a partner EMT, or with assistance from an instructor.

A feedback device 200 provides feedback, such as audio, visual, tactile, and/or another type of feedback, to aid the caregiver in the delivery of CPR to the victim 102. The feedback device 200 may provide feedback indicating whether one or more CPR parameters are within a target range. For instance, the feedback device 200 may provide feedback about the rate of chest compressions applied to the victim 102 during CPR, a depth of the chest compressions, and/or another characteristic of the chest compressions. The feedback device 200 may be a stand-alone electronic device or may be incorporated into a device capable of one or more other functions. For example, feedback operations (e.g., presenting feedback) may be provided a computing devices (e.g., laptop or desktop computer, tablet computing device, smartphone, etc.) or another type of electronic device (e.g., an AED).

The feedback device 200 may provide sequential feedback about multiple CPR parameters, e.g., by providing initial feedback about a first CPR parameter and subsequent feedback about a second CPR parameter. The feedback device 200 may provide initial feedback about whether a first CPR parameter (e.g., the rate of chest compressions) matches a target value or falls within a target range for the first parameter, while providing no feedback about a second CPR. As such the caregiver can focus on the feedback for the first parameter and not become distracted by other signals, e.g., associated with the second feedback signal. When the first CPR parameter matches its target value or falls within its target range, the feedback device 200 may begin to provide subsequent feedback about whether the second CPR parameter (e.g., the depth of chest compressions) matches a target value or falls within a target range for the second parameter. During the time period that feedback information is provided about the second CPR parameter, no feedback signals are provided about the first CPR parameter. Again, by allowing the caregiver to focus on one parameter at a time, the likelihood of confusion may be reduced. The operation of the feedback device 200 is described herein for the example of providing initial feedback about the rate of chest compressions and subsequent feedback about the depth of chest compressions. In other examples, the feedback device 200 can provide initial feedback about the depth of chest compression and subsequent feedback about the rate of chest compressions. The feedback device 200 can also provide feedback about other CPR parameters.

The feedback device 200 may be designed to be positioned on the chest of the victim 102 such that the motion of the victim's chest during delivery of CPR can be sensed. In some examples, the feedback device 200 can be positioned directly under the caregiver's hands such that the caregiver 104 presses on the feedback device 200 during application of chest compressions. In some examples, the feedback device 200 can be placed on the victim's chest near the caregiver's hands, e.g., as close to the hands as possible. In some examples, the feedback device 200 can be attached to the caregiver's hand, e.g., via a strap that attaches the feedback device 200 to the back of the caregiver's upper hand. In some examples, the feedback device 200 can be held in the caregiver's upper hand.

The feedback device 200 may be handheld computing device capable of monitoring and providing feedback about compression rate and compression depth. The feedback device 200 may be sized such that the caregiver can easily apply chest compressions to the victim with the feedback device 200 positioned under his hands. For instance, the length and width of the feedback device can be approximately the size of an adult hand (e.g., about 3 to 6 inches in length and width). The height of the feedback device 200 can be small enough that the caregiver's hands can be close to the victim's chest when applying chest compressions to the victim. For instance, the height of the feedback device 200 can be less than about one inch. In some examples, the feedback device may be a dedicated CPR feedback device. In some examples, the feedback device may be a computing device, such as a smartphone or other mobile computing device, executing software that enables the computing device to carry out the operations of the feedback device. In some examples, the feedback device may be a handheld sensor, a sensor embedded in a defibrillator electrode, or another type of sensor, in electronic communication with a computing device, such as a laptop or desktop computer, an AED, or another computing device.

Figure 2:
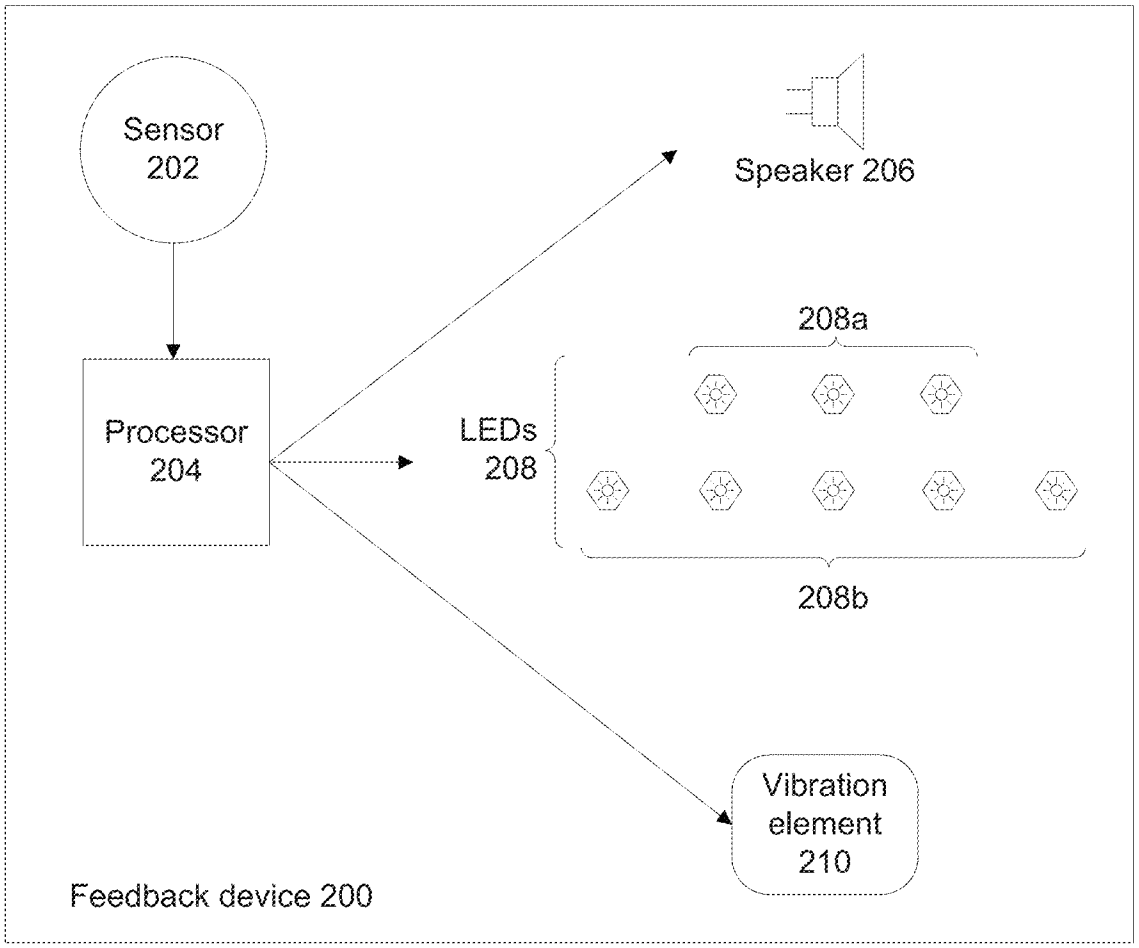
FIG. 2 is a diagram of a feedback device.

Referring to FIG. 2, the feedback device 200 includes one or more sensors (e.g., sensor 202). The sensor 202 may collect signals and sense other phenomena. The feedback device 200 may include a sensor measuring chest compressions applied to the patient 102. For example, the sensor 110 may include an accelerometer assembly, such as a housing inside which is mounted an accelerometer sensor configuration. The accelerometer assembly may be positioned in a location where the caregiver 104 is to place the palms of their hands when performing CPR chest compressions on the victim 102. As a result, the accelerometer assembly may move with the victim's 102 chest and the caregiver's hands, and acceleration of such movement may be double-integrated to identify a vertical displacement of such motion. In some arrangements the accelerometer assembly may include two or more accelerometer that may be used in concert to provide the chest compression signal (e.g., provide an averaged signal from the multiple sensors) to the AED 108. Further, other types of technology may be employed alone or in combination (e.g., in concert with the accelerometer assembly) to produce a signal representative of chest compressions. For example, one or more pressure sensors, ultrasound technology, string gauges, laser interferometry, magnetic field technology, etc. may implemented for providing chest compression signals. Different types of signals may also be used for attaining information representative of chest compressions. For example, the feedback device 200 may include a sensor, e.g., associated with the defibrillator electrode pads 110, for collecting electrocardiogram (ECG) signals read from the victim 102 that can be used for identifying chest compression during CPR treatment.

Data (e.g., acceleration data) from the sensor 202 is provided to a processor 204 (e.g., a microprocessor). Based on the acceleration data, the processor 204 can calculate one or more CPR parameters such as compression rate or velocity; compression depth; a sternal motion signal (e.g., sternal position, velocity, and/or acceleration); duty cycle; velocity of downstroke and/or upstroke; introthoracic pressure(s) during compressions; pleural pressure(s) during compressions; chest wall or sternal strain or deformation; force applied to the chest; pressure used to compress the chest by a mechanical chest compressor; or another compression parameter. In some examples, the sensor 202 is incorporated into the feedback device 200 (as shown in FIG. 2). In some examples, the sensor 202 is external to the feedback device and connected electronically to the processor 204. For instance, the sensor may be embedded in a defibrillator electrode pad that is positioned separately on the victim's chest and connected electronically to a handheld feedback device, e.g., via a wired or wireless connection.

The feedback device 200 includes one or more output devices for providing audio, visual, tactile, and/or other types of feedback to the caregiver. For instance, audio feedback may be provided via a speaker 206 capable of providing direct audible feedback to the caregiver. Visual feedback may be provided by one or more light producing devices, such as light-emitting diodes (LEDs), organic light-emitting diodes (OLEDs), or another type of light producing device. For instance, in the example of FIG. 2, LEDs 208 provide visual feedback and are positioned such that there is a direct line of sight from the caregiver to the LEDs 208. In this illustrated example, a first set 208*a* of one or more LEDs is dedicated to providing feedback about compression rate and a second set 208*b* of one or more LEDs is dedicated to providing feedback about compression depth. In some examples, the same LEDs are used to provide feedback about both compression rate and compression depth. Visual feedback may also be provided via graphics on a display screen (not shown), such as a liquid crystal display (LCD) screen or another type of graphics display screen. In some examples, the display screen is embedded in the feedback device. In some examples, the display screen is included in a separate device, such as a mobile computing device, the AED 108, or another device, that is in communication with the feedback device. Tactile feedback may be provided by a vibration element 210, such as an electric motor or one or more transducers, such as an electro-mechanical transducer. Other types of feedback are also possible.

Figure 3:
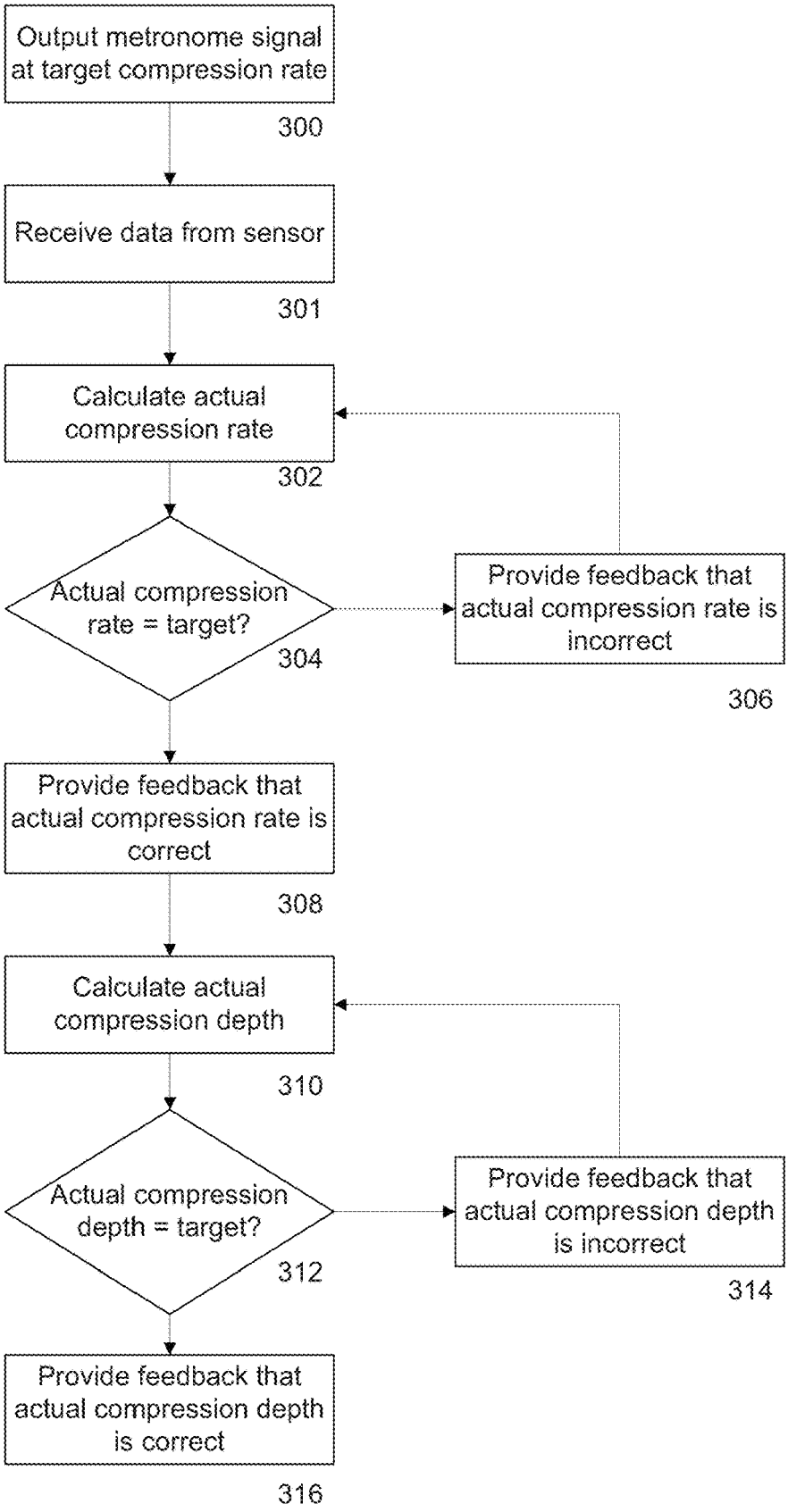
FIG. 3 is a flowchart.

Referring also to FIG. 3, in operation, the feedback device 200 may output a metronome signal at a target compression rate (300). For instance, one or more LEDs 208 may flash at the target compression rate, an audio signal such as a beep may be emitted by the device to provide an audible guide for the caregiver to adjust application of the compression to achieve the target compression rate, and/or another signal may be provided at the target compression rate. The metronome signal may be provided before CPR begins or may start after CPR has already been initiated.

During application of chest compressions, the processor 204 receives data, such as acceleration data, from the sensor 202 (301). Based on the data, the processor 204 calculates the actual compression rate of compressions being applied to the victim (302) and determines whether the actual compression rate matches the target compression rate or falls within a target range for the compression rate (304). In some examples, the target compression rate may be, e.g., approximately 100 compressions per minute. In some examples, the target range for the chest compression rate may be, e.g., greater than about 100 compressions per minute (a guideline specified by the American Heart Association®), or between about 100 and about 120 compressions per minute (a guideline specified by the International Liaison Committee on Resuscitation (ILCOR)). Other target compression rates and/or target ranges may also be specified, e.g., based on other guidelines or based on specific CPR situations. For instance, the target compression rate and/or target range may be different for applying chest compressions to children or infants.

If the actual compression rate does not match the target compression rate and/or does not fall within the target range (e.g., the caregiver is applying chest compressions too quickly or too slowly), the feedback device provides feedback indicating that the actual compression rate is incorrect (306). In some examples, the feedback specifies whether the actual compression rate is too high or too low. For instance, a different feedback signal may be provided depending on whether the actual compression rate is too high or too low. In some examples, the feedback indicates generally that the actual compression rate is incorrect. For instance, a single feedback signal (e.g., an audio tone, a flashing light, or a vibration) may be provided to alert the caregiver that the actual compression rate does not match the target compression rate and/or does not fall within the compression range, but without specifying whether the actual compression rate is too high or too low.

In some examples, audio feedback may be provided via the speaker 206. The audio feedback may include an audio alert, such as a beep, a discordant tone, or another audio alert, that is played when the actual compression rate is incorrect. The audio feedback may include a periodic audio signal at the target compression rate. For instance, the audio metronome signal may be played more loudly or with a discordant tone when the actual compression rate is incorrect. The audio feedback may include a statement, such as "Push slower" if the actual compression rate is too high and "Push faster" if the actual compression rate is too low. The audio feedback may include a periodic statement, such as "Slower, slower, slower" or "Faster, faster, faster" at the target compression rate (e.g., 100 statements per minute, such that the statements start at 0.6 second intervals).

In some examples, visual feedback may be provided by powering one or more LEDs 208, OLEDs, or another type of light producing device. In some arrangements, the LEDs 208 may be powered continuously when the actual compression rate is incorrect. The LEDs 208 may periodically flash at the target compression rate when the actual compression rate is incorrect to provide a visual guide for the caregiver. For instance, a first LED may be illuminated continuously or may flash at the target compression rate if the actual compression rate is too high, and a second, different LED may be illuminated continuously or may flash at the target compression rate if the actual compression rate is too low. Other types of visual feedback, such as a gauge or a graphical representation of a gauge, may also be provided.

In some examples, visual feedback may be provided on a display screen, such as an LCD screen or another type of display screen. For instance, the display screen may display images of continuously illuminated or flashing lights that mimic the behavior of the LEDs 208 described above. The display screen may display textual messages, such as "Push slower," "Push faster," or "Good rate." The display screen may display a gauge that indicates the actual compression rate. The display may be color-coded, for instance, to aid the caregiver in interpreting the display. In one arrangement, a green light may be displayed when the compression rate is correct and a red light may be displayed when the compression rate is incorrect.

In some examples, tactile feedback may be provided, e.g., that causes the feedback device 200 to vibrate when the compression rate is incorrect. The vibration may be a periodic vibration at the target compression rate. The vibration may be an alert vibration, such as one alert vibration per period of time (e.g., one vibration per five seconds, ten seconds, or another period of time) or one alert vibration each time the actual compression rate deviates from the target compression rate or target range.

The feedback device 200 continues to calculate the actual compression rate (302) and compare the actual compression rate to the target compression rate or target range (304) until the actual compression rate matches the target compression rate and/or falls within the target range. When this occurs, the feedback device 200 may provide feedback indicating that the actual compression rate is correct (308). For instance, an audio message (e.g., stating "Good rate!") or an audio alert, such as a beep, a harmonious tone, or another audio alert, may be provided. One or more LEDs may be illuminated, may flash at the target compression rate, and/or may be turned off. An alert vibration (e.g., a single vibration or a vibration at the target compression rate) may be provided. In some examples, the metronome signal at the target compression rate may be continued once the actual compression rate is correct. In some examples, the metronome signal may be discontinued once the actual compression rate is correct.

After the actual compression rate matches the target compression rate and/or falls within the target range, the processor 204 uses the acceleration data from the sensor 202 to calculate the actual depth of compressions being applied to the victim (310) and determines whether the actual compression depth matches the target compression depth and/or falls within a target range for the compression depth (312). The target range for the compression depth may be, e.g., greater than about 2 inches (a guideline specified by the American Heart Association®) or between about 5 centimeters and about 6 centimeters (a guideline specified by ILCOR). Another target compression depth and/or target range may also be specified, e.g., based on other guidelines or based on specific CPR situations. For instance, the target compression depth and target range may be different for delivery of CPR to children or infants.

If the actual compression depth does not match the target compression depth and/or does not fall within the target range (e.g., the compressions are too deep or too shallow), the feedback device may provide feedback indicating that the actual compression depth is incorrect (314). In some examples, the feedback indicates generally that the actual compression depth is incorrect. In some examples, the feedback specifies whether the actual compression depth is too high or too low.

In some examples, audio feedback may be provided via the speaker 206. The audio feedback may include an audio alert, such as a beep, a discordant tone, or another audio alert, that is played when the actual compression depth is incorrect. The audio feedback may include a statement, such as "Push less" if the actual compression depth is too deep and "Push more" if the actual compression depth is too shallow. The audio feedback may be provided at the target compression rate. For instance, the audio feedback may include a periodic statement such as "Less, less, less" or "Deeper, deeper, deeper," delivered at the target compression rate (e.g., 100 statements per minute).

In some examples, visual feedback may be provided by powering one or more of the LEDs 208, OLEDs, or another type of light producing device. For instance, some or all of the LEDs 208 may be arranged substantially linearly and sequentially turned on and turned off, e.g., at the target compression rate, to simulate a bouncing bar. The number of LEDs that are turned on and turned off may indicate the actual compression depth. For instance, if the compression depth is shallow, only a small number of LEDs (e.g., only one or two LEDs) may participate in the bouncing bar simulation. If the compression depth is deep, many or all of the LEDs (e.g., four or five LEDs) may participate in the bouncing bar simulation. Other types of visual feedback, such as a gauge, may also be provided.

In some examples, visual feedback may be provided on a display screen, such as an LCD screen or another type of display screen. For instance, a bouncing bar may be displayed that mimics the behavior of the sequential LEDs described above. A gauge may be displayed that indicates the actual compression depth. Messages, such as "Push harder," "Push less," or "Good compressions" may be displayed. The display may be color-coded, for instance, to aid the caregiver in interpreting the display. For instance, a green light may be displayed when the compression depth is correct and a red light may be displayed when the compression depth is incorrect.

In some examples, tactile feedback may be provided, e.g., that causes the feedback device 200 to vibrate when the compression depth is incorrect. The vibration may be an alert vibration, such as one alert vibration per period of time (e.g., one vibration per five seconds, ten seconds, or another period of time) or one alert vibration each time the actual compression depth deviates from the target compression depth or target range.

The feedback device 200 continues to calculate the actual compression depth (310) and compare the actual compression depth to the target compression depth or target range (312) until the actual compression depth matches the target compression depth and/or falls within the target range. When this occurs, the feedback device 200 may provide feedback indicating that the actual compression depth is correct (316). For instance, an audio message (e.g., stating "Good depth!") or an audio alert, such as a beep, a harmonious tone, or another audio alert, may be provided. One or more LEDs may be illuminated, may flash at the target compression rate, and/or may be turned off. An alert vibration (e.g., a single vibration or a vibration at the target compression rate) may be provided.

In some examples, the feedback device 200 continues to monitor the compression rate while monitoring the compression depth. If the compression rate deviates from the target compression rate or target range (e.g., the compression rate slows down or speeds up), the feedback device 200 may cease monitoring the compression depth and return to providing feedback about the compression rate (306). In some examples, once the compression rate is correct, the feedback device 200 may cease monitoring the compression rate and begin monitoring the compression depth. Once the compression depth is correct, the feedback device 200 may alternate between monitoring compression rate and compression depth.

In some examples, if the actual compression rate is not correct after a set period of time (e.g., about 15 seconds), the feedback device 200 may begin to monitor compression depth. Feedback may be provided indicating that the rate is still incorrect. For instance, an LED (e.g., one of the LEDs 208) indicating that the compression rate is incorrect may be powered, or an LED that typically indicates that the compression rate is correct may be turned off.

Figure 4A:
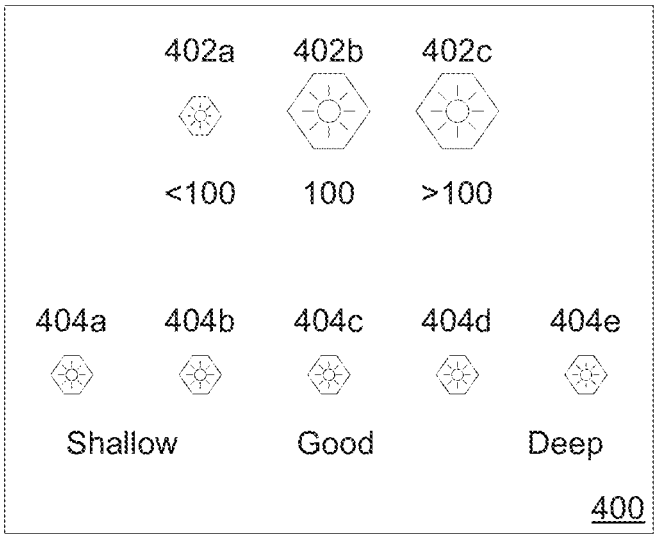
FIGS. 4A and 4B are diagrams of an example feedback device.
Figure 4B:
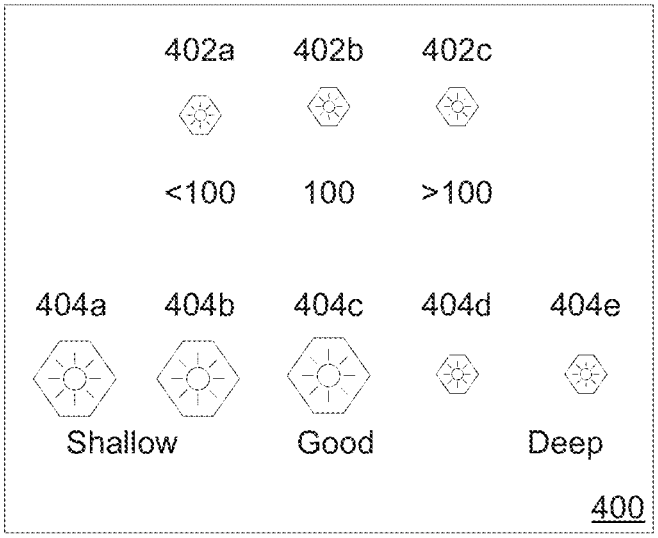

Referring to FIGS. 4A and 4B, an example feedback device 400 includes a first set of LEDs 402*a*, 402*b*, 402*c* for providing visual feedback about the compression rate and a second set of LEDs 404*a*, 404*b*, 404*c*, 404*d*, 404*e* for providing visual feedback about the compression depth. Other example feedback devices may include other types of light producing devices, such as OLEDs.

In FIG. 4A, the feedback device 400 is providing feedback about the compression rate and is not monitoring the compression depth. The center LED 402*b* may be designated as the reference LED and labeled with the target compression rate (e.g., "100"). One of the side LEDs (e.g., LED 402*a*) may be designated as the low rate LED and labeled with that designation (e.g., "<100"). The other side LED (e.g., LED 402*c*) may be designated as the high rate LED and labeled with that designation (e.g., ">120"). Other configurations are also possible. In some examples, the LEDs 402*a*, 402*b*, 402*c* are colored for easy reference by the caregiver. For instance, the reference LED 402*b* may be white and the LEDs 402*a*, 402*c* may be orange. Other colors, such as other colors that are bright enough to be visible in direct sunlight, may also be used. For instance, each LED 402*a*, 402*b*, 402*c* may be a different color, or the three LEDs 402*a*, 402*b*, 402*c* may be all the same color.

The reference LED 402*b* flashes at the target compression rate (e.g., 100 beats per minute) when the feedback device 400 is first turned on and/or when CPR is initiated. If the actual compression rate is too low (e.g., if the actual compression rate is less than about 100 beats per minute), both the low rate LED 402*a* and the reference LED 402*b* flash at the target compression rate. If the actual compression rate is too high (e.g., if the actual compression rate is greater than about 120 beats per minute), both the high rate LED 402*c* and the reference LED 402*b* flash at the target compression rate. For instance, in the example of FIG. 4A, the high rate LED 402*c* and the reference LED 402*b* are both flashing, indicating that the compression rate is excessive.

In some examples, other feedback, such as audio feedback or tactile feedback, can be provided along with the LED display. For instance, in this example, periodic statements saying "Slower, slower, slower" may be provided along with the LED display.

In some examples, once the actual compression rate falls within the target range (e.g., between about 100 and 119 beats per minute), the low and high LEDs 402*a*, 402*c* turn off and the reference LED 402*b* continues to flash at the target compression rate. In some examples, once the actual compression rate falls within the target range, the low and high LEDs 402*a*, 402*c* turn off and the reference LED 402*b* changes to continuous illumination. In some examples, once the actual compression rate falls within the target range, all three LEDs 402*a*, 402*b*, 402*c* turn off.

Referring to FIG. 4B, once the compression rate is correct, monitoring of compression depth can begin. In the example shown, five LEDs 404*a*-404*e* are arranged substantially linearly and are turned on sequentially and turned off sequentially, e.g., at the target compression rate, to simulate a bouncing bar. In the example shown, five LEDs 404*a*-404*e* provide depth feedback; however, more or fewer LEDs can also be used.

The number of LEDs 404*a*-404*e* turned on in sequence indicates the compression depth. For instance, if the compression depth is below a minimum threshold (e.g., about 1.2 inches, or about 2 centimeters), the first LED 404*a* flashes at the target compression rate. If the compression depth is in a low range (e.g., between about 1.2 and 1.6 inches), the first and second LEDs 404*a*, 404*b* are turned on sequentially and turned off sequentially at the target compression rate to simulate an animated bouncing bar (i.e., the first LED 404*a* turns on, then the second LED 404*b* turns on, then the second LED 404*b* turns off, then the first LED 404*a* turns off).

If the compression depth is in a first moderate range (e.g., between about 1.6 and 2.0 inches), the first, second, and third LEDs 404*a*-404*c* are turned on sequentially and turned off sequentially at the target compression rate. If the compression depth is in second moderate range (e.g., between about 2.0 and 2.4 inches, or between about 5 and 6 centimeters), the first through fourth LEDs 404*a*-404*d* are turned on sequentially and turned off sequentially at the target compression rate. If the compression depth is in a high range (e.g., greater than about 2.4 inches, or greater than about 6 centimeters), the first through fifth LEDs 404*a*-404*e* are turned on sequentially and turned off sequentially at the target compression rate.

In the example of FIG. 4B, the first three LEDs 404*a*-404*c* are graphically illustrated as being turned on, indicating that the compression depth is between about 1.6 and 2.0 inches. That is, LEDs 404*a*, 404*b*, 404*c* each turned on in sequence at the target compression rate (e.g., one LED was turned on every 0.6 milliseconds). Once the three LEDs 404*a*-404*c* are turned on, as shown in FIG. 4B, the three LEDs will turn off in sequence at the target compression rate (i.e., LED 404*c* turns off, followed by LED 404*b*, followed by LED 404*a*).

Visual cues 406, such as labels and colors, may be used to indicate which LEDs correspond to compressions with good depth, shallow compressions, and/or deep compressions. In some examples, other feedback, such as audio feedback or tactile feedback, can be provided along with the LED display. For instance, in this example, periodic statements saying "Harder, harder, harder" may be provided along with the LED display.

Figure 5B:
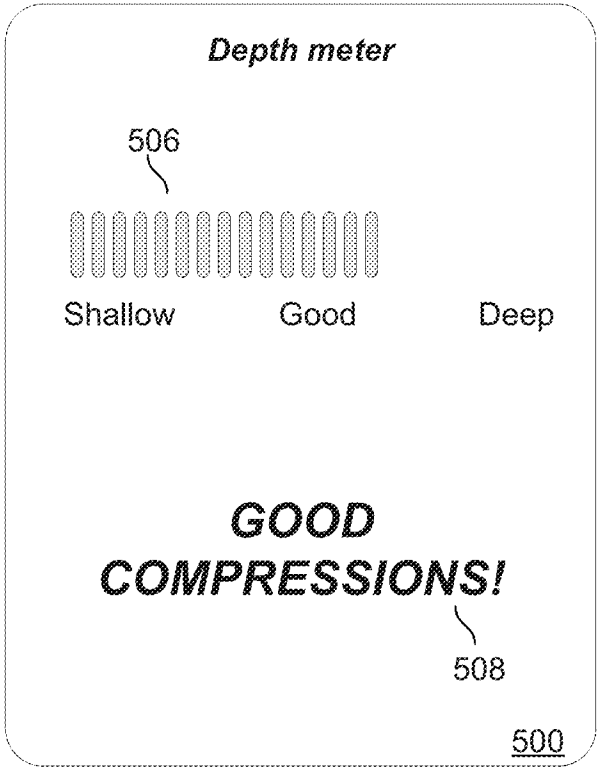
FIGS. 5A and 5B are diagrams of an example feedback display.
Figure 5A:
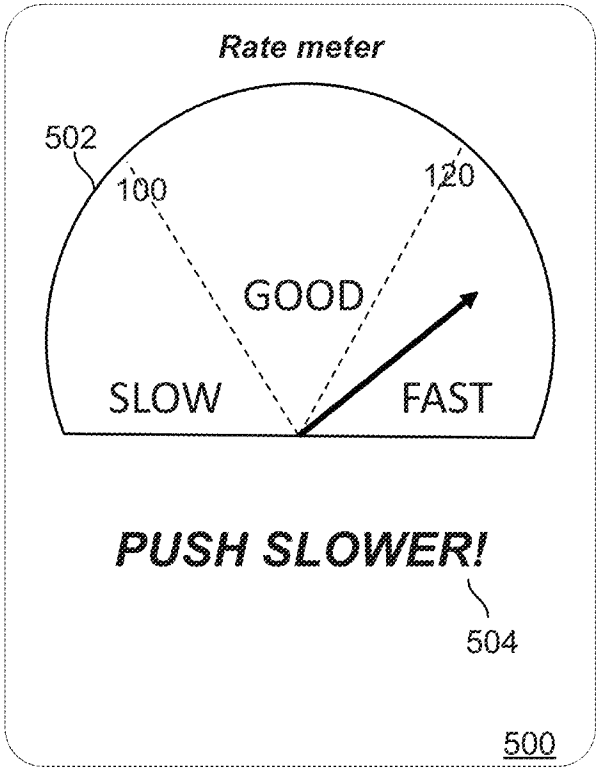

Referring to FIGS. 5A and 5B, an example display 500 for a feedback device displays visual feedback about the compression rate (FIG. 5A) and compression depth (FIG. 5B). The display 500 may be displayed on, e.g., an LCD screen or another type of display screen on a feedback device. For instance, the display 500 displayed on a screen of an electronic device, such as a smartphone, a tablet, a standalone CPR feedback device, an AED, a laptop or desktop computer, or another electronic device.

Referring to FIG. 5A, during compression rate monitoring, the display 500 shows visual feedback about the compression rate. In the example shown, the display 500 shows a speedometer-type gauge 502 that indicates the actual compression rate. Other displays are also possible. For instance, images or videos of lights that mimic the behavior of the LEDs 402*a*-*c* may be displayed. A message 504, such as text "Push slower," "Push faster," or "Good rate" may be displayed. The display may be color-coded, for instance, to aid the caregiver in interpreting the display. For instance, a green light may be displayed when the compression rate is correct and a red light may be displayed when the compression rate is incorrect.

In the example of FIG. 5A, the actual compression rate is too high, as indicated by the gauge 502 and the message 504 stating "Push slower!"

Referring to FIG. 5B, during compression depth monitoring, the display shows visual feedback about the compression depth. In the example shown, the display 500 shows a bouncing bar 506 that mimics the behavior of the sequentially flashing LEDs 404*a*-404*e* (e.g., individual bars of the bouncing bar 506 sequentially appear and then sequentially disappear). The maximum length of the bouncing bar 506 (e.g., the maximum number of individual bars that are displayed) corresponds to the actual compression depth. Other displays are also possible. For instance, a speedometer-type gauge may be displayed that indicates the actual compression depth. Messages 508, such as "Push harder," "Push less," or "Good compressions" may be displayed. The display may be color-coded, for instance, to aid the caregiver in interpreting the display. For instance, a green light may be displayed when the compression depth is correct and a red light may be displayed when the compression depth is incorrect.

In the example of FIG. 5B, the actual compression depth is correct, as indicated by the bouncing bar 506 and the message 508 stating "Good compressions!" That is, the bouncing bar 506 is illuminated as far as the "Good" range of depth.

The features described herein can be implemented in digital electronic circuitry, or in computer hardware, firmware, software, or in combinations of them. The apparatus can be implemented in a computer program product tangibly embodied in an information carrier, e.g., in a machine-readable storage device, for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network, such as the described one. The relationship of client and server arises by virtue of computer programs running on the respective computers and having a client-server relationship to each other.

It is to be understood that the foregoing description is intended to illustrate and not to limit the scope of the invention, which is defined by the scope of the appended claims. Other embodiments are within the scope of the following claims.

What is claimed is:

1. A system comprising:

at least one sensor configured to detect a signal representative of chest compressions being applied to a patient;

a processor operatively connected to the at least one sensor and configured to receive the signal representative of chest compressions being applied to the patient from the at least one sensor; and an output element operatively connected to the processor, the processor configured to:

calculate, based on the signal representative of chest compressions being applied to the patient, a first parameter of the chest compressions;

determine if the first parameter of the chest compressions falls within a first target range;

cause the output element to output a first feedback indicative of the first parameter;

calculate, based on the signal representative of chest compressions being applied to the patient, a second parameter of the chest compressions;

determine if the second parameter of the chest compressions falls within a second target range;

withholding feedback indicative of the second parameter of the chest compressions until the first parameter falls within the first range; and after the output element outputs the first feedback indicative of the first parameter and when the first parameter falls within the first range, cause the output element to output a second feedback indicative of the second parameter.

2. The system of claim 1, wherein the first parameter comprises chest compression rate.

3. The system of claim 1, wherein the second parameter represents comprises chest compression depth.

4. The system of claim 1, wherein the at least one sensor comprises an accelerometer.

5. The system of claim 1, wherein the first feedback and/or the second feedback comprises at least one of audio feedback, visual feedback, and/or tactile feedback.

6. The system of claim 1, wherein the output element comprises at least one of a speaker, a display screen, one or more lights, a gauge, and a vibration element.

7. The system of claim 1, wherein the first feedback indicates that the first parameter is one or more of the following: within the first target range, below the first target range, and above the first target range.

8. The system of claim 1, wherein the processor is configured to cause the output element to output the first feedback prior to calculating the second parameter.

9. The system of claim 1, wherein the first parameter comprises chest compression rate, and wherein the output element includes at least one light configured to flash at a target compression rate.

10. The system of claim 1, wherein the second parameter comprises chest compression depth, and wherein the output element includes a plurality of lights configured to turn on and turn off sequentially based on the compression depth.

11. The system of claim 1, wherein the processor is configured to discontinue the first feedback indicative of the first parameter when the first parameter falls within the first range and when the output element outputs the second feedback indicative of the second parameter.

12. An apparatus comprising:

at least one sensor configured to detect a signal representative of chest compressions being applied to a patient;

one or more output elements configured to provide chest compression rate feedback and chest compression depth feedback; and a processor operatively connected to the at least one sensor to receive the signal representative of chest compressions being applied to the patient from the at least one sensor and the one or more output elements, the processor configured to:

calculate a rate of chest compressions applied to the patient based on the signal;

determine if the rate of chest compressions falls within a first target range;

control at least one of the output elements based on the calculated rate to provide a first feedback regarding the calculated rate;

calculate a depth of chest compressions applied to the patient based on the signal;

determine if the depth of chest compressions falls within a second target range;

preventing the output elements from providing feedback regarding the depth of chest compressions until rate of chest compressions falls within the first range; and after at least one of the output elements provides the first feedback regarding the calculated rate and when the rate of chest compressions falls within the first target range, control at least one of the output elements based on the calculated depth to provide a second feedback regarding the calculated depth.

13. The apparatus of claim 12, wherein the one or more output elements comprise a first set of lights configured to represent a rate that the chest compressions are applied to the patient.

14. The apparatus of claim 13, wherein controlling the first set of lights includes causing at least one of the first set of lights to flash at a target compression rate.

15. The apparatus of claim 13, wherein controlling the first set of lights includes:

causing a first one of the first set of lights to flash at a target compression rate if the calculated rate is below the first target rate range; and causing a second one of the first set of lights to flash at the target compression rate if the calculated rate is above the first target rate range.

16. The apparatus of claim 13, wherein controlling the first set of lights includes causing a first one of the first set of lights to be illuminated continuously when the calculated rate falls within the target rate range.

17. The apparatus of claim 13, wherein controlling the first set of lights includes causing the first set of lights to turn off when the calculated compression rate falls within the target rate range.

18. The apparatus of claim 13, wherein the one or more output elements further comprises a second set of lights configured to represent a depth that the chest compressions are applied.

19. The apparatus of claim 18, wherein controlling the second set of lights includes causing at least a subset of the second set of lights to turn on sequentially and turn off sequentially.

20. The apparatus of claim 18, wherein controlling the second set of lights includes:

causing a first subset of the second set of lights to turn on sequentially and turn off sequentially if the calculated depth is below a target depth range;

causing a second subset of the second set of lights to turn on sequentially and turn off sequentially if the calculated depth is within the target depth range; and causing a third subset of the second set of lights to turn on sequentially and turn off sequentially if the calculated depth is above the target depth range, wherein the third subset includes more lights than the second subset, and wherein the second subset includes more lights than the first subset.

21. The apparatus of claim 12, wherein the one or more output elements comprise one or more of light emitting diodes (LEDs) and organic light emitting diodes (OLEDs).

22. The apparatus of claim 12, wherein the one or more output elements comprise images of lights displayed on a display screen.

* * * * *